US005361089A

United States Patent [19]

Bearss et al.

[11] Patent Number: 5,361,089

[45] Date of Patent: Nov. 1, 1994

[54] METHOD AND APPARATUS FOR APPLYING AN ADHESIVE LAYER FOR IMPROVED IMAGE TRANSFER IN ELECTROPHOTOGRAPHY

[75] Inventors: James G. Bearss; Dale D. Russell, both of Boise, Id.

[73] Assignee: Hewlett-Packard Company, Palo Alto, Calif.

[21] Appl. No.: 97,815

[22] Filed: Jul. 26, 1993

[51] Int. Cl.[5] ..... B41J 2/435

[52] U.S. Cl. ..... 346/160; 355/280; 355/246

[58] Field of Search ..... 346/1.1, 107 R, 76 L, 346/108, 160; 355/245, 246, 256, 280

[56] References Cited

U.S. PATENT DOCUMENTS

| | | | |
|---|---|---|---|
| 4,316,666 | 2/1982 | Ceelen | 355/280 |
| 4,346,983 | 8/1982 | Jeromin et al. | 355/256 |
| 4,562,136 | 12/1985 | Inoue et al. | 430/107 |
| 4,754,294 | 1/1988 | Kato | 346/160 |

*Primary Examiner*—Mark J. Reinhart

[57] ABSTRACT

An imaging system incorporating the invention includes a movable photoconductive surface, and an electrostatic system for repetitively charging the photoconductive surface to a first charge potential. A laser system selectively discharges the photoconductive surface to a second charge potential in accordance with image signals. A color toner supply provides color toner to the photoconductive surface, the color toner exhibiting a charge state that is attracted by the second charge potential and is repelled by the first charge potential. An adhesive toner supply provides adhesive toner to the photoconductive surface, the adhesive toner exhibiting an opposite sense charge state to the color toner. The adhesive toner is attracted by the first charge potential and is repelled by the second charge potential. A controller causes the color toner to be applied to the photoconductive surface and the entire photoconductive surface is recharged. Thereafter the laser system discharges non-imaged areas of the photoconductive surface to a charge potential that repels the adhesive toner. Then, the adhesive toner is applied to imaged areas which remain at the first charge potential. During a subsequent image transfer the adhesive toner aids in complete image transfer.

7 Claims, 2 Drawing Sheets

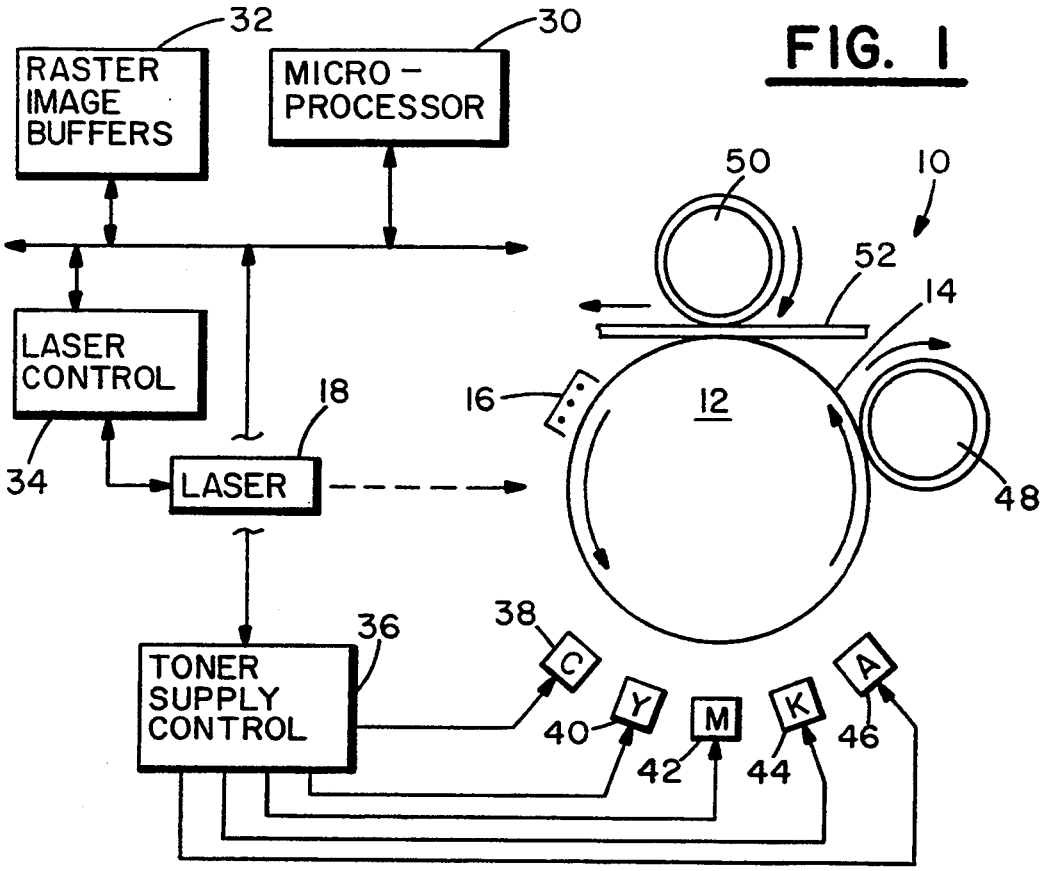
FIG. 1
FIG. 2
(D.A.D.)
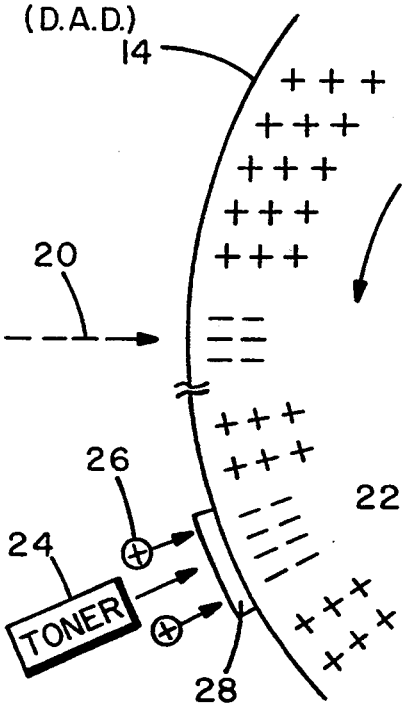
FIG. 3
(C.A.D.)
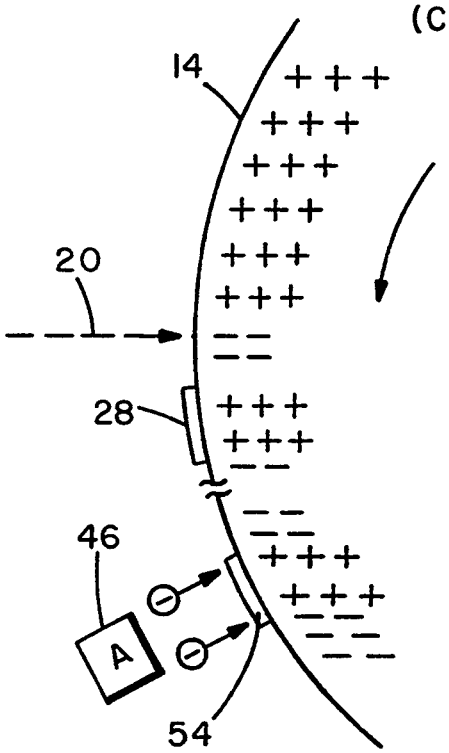

METHOD AND APPARATUS FOR APPLYING AN ADHESIVE LAYER FOR IMPROVED IMAGE TRANSFER IN ELECTROPHOTOGRAPHY

FIELD OF THE INVENTION

This invention relates generally to adhesive promotion between a toner and a carrier sheet in an electrophotographic printer, more particularly, to a method and system for selectively applying an adhesion promoter to a pretoned surface.

BACKGROUND OF THE INVENTION

As is known, a photoconductive surface in an electrophotographic printer is first charged to a uniform potential and then is "exposed" to an image to be reproduced by the scanning of a laser beam thereacross. The photoconductor thereby obtains an electrostatic latent image which, in a preferred embodiment, constitutes a matrix of discharged pixels on the photoconductor's surface. In a black/white printer, the photoconductive surface is developed using a black toner which adheres to the discharged pixel areas to form the image. Thereafter, the toned photoconductive surface is then carried to a transfer station where the image is transferred to a media sheet.

In a multi-color printer, successive images are developed employing different color toners supplied from corresponding toner modules. Color printing is normally done with yellow, cyan and magenta toners that are applied, in registration, during successive rotations of the photoconductive surface. The printer also generally includes a toner module with black toner since it is required in virtually all commercial color printing applications. The developed color image is then transferred from the photoconductive surface to a media sheet. Heat is usually applied to permanently fuse the image to the media sheet in order to form a completed multi-color print.

A number of factors may hinder transfer of a developed image to a media sheet and cause impaired image quality. For instance, transfer efficiency is uncertain if adhesion of the toner to the photoconductive surface is more favored energetically than adhesion of the toner to a paper surface (i.e. direct transfer), or to an intermediate transfer surface (i.e. indirect transfer). Paper sheets have a surface roughness which is dimensionally greater than toner particle size and is sometimes greater than the dimensions of the image to be imprinted. At high resolutions, very small image elements may not be successfully transferred to a paper sheet, and in extreme circumstances, may not even contact the paper. A second mode of incomplete image transfer may occur when an imaged (toned) area lacks sufficient mechanical integrity to transfer to a sheet without tearing. If parts of the image contact the sheet, but other parts do not, the image may separate. Each of these incomplete transfers may occur both in black/white and color electrophotographic printers.

The prior art includes a number of methods for improving efficiency of image transfer. In general, such methods employ a sheet of laminating material to improve transfer efficiency. The laminating material is often a thin sheet of a fusible polymer which is brought into pressure contact with the photoconductor, usually by a roller or belt. In U.S. Pat. Nos. 4,489,122 to Karorain et al, 5,060,981 to Fossum et al. and 4,968,063 to McConville et al, a laminating sheet is laid over the photoconductor prior to imaging and developing steps. The toner is directly developed onto the laminating sheet and never comes in direct contact with the photoconductive surface. In such case, the image is completely removed from the photoconductor and laminated onto a receiving material, usually paper. The transfer is accomplished directly in a single step and there is no chance for incomplete transfer unless the lamination sheet tears. A principle disadvantage of this method is that the top layer of the final image is the laminating sheet. Thus, the entire paper, including the imaged areas and the background, is coated with a polymeric, glossy, transfer sheet. This changes both the feel and appearance of the paper in ways that may not be aesthetically pleasing. It also adds to the cost per page. The electrophotographic process must also take into account that the photoconductive surface is coated with a dielectric during the charge, expose and development phases of the process. Any quality control issues associated with the thickness or electrical properties of the laminating sheet may impact negatively on print quality.

U.S. Pat. Nos. 5,106,710 to Wang et al, 5,023,668 to Kluy et al, and 5,108,865 to Zwadlo et al describe a second method for assisting transfer of a toned image from a photoconductive surface. An adhesive sheet is presented to the photoconductive surface after imaging and development. The adhesive sheet is pressed to the photoconductive surface and over the image, employing a roller or belt, with the adhesive side facing the toned image. The toner, having a greater affinity for the adhesive sheet than for the photoconductive surface, is literally pulled off the photoconductive surface.

If a single step direct transfer procedure is employed, the adhesive sheet is the layer next to the paper and the color planes appear on top of it. The adhesive sheet is generally fused to affix it to the paper. The face-up adhesive surface (which would be exposed in non-imaged areas) is also fused at this time and presumably loses its tackiness.

More often, image transfer occurs in a two step process, in which case the adhesive sheet, with color image areas adhering to it, is transferred first to an intermediate roller or belt, with the adhesive (and image) side up. It is then transferred again, adhesive side down, onto the final sheet, usually paper. After fusing, the surface may subsequently be abraded to reduce the gloss of the outer layer which is the polymeric adhesive sheet. The principle advantage of this method is that imaging is directly on the photoconductive surface and permits a different set of electrophotographic conditions than where an insulative layer intervenes between the photoconductive surface and the toner. The disadvantages of the process include increased cost per page, and as above, a different feel and look to the printed page. Further, any irregularity in the manner in which the adhesive sheet is laid against the photoconductive surface will degrade the print quality of the image.

Accordingly, it is an object of this invention to provide an improved method and system for toned image transfer from a photoconductive surface.

It is another object of this invention to provide an improved method of image transfer from a photoconductive surface which avoids the need for use of intermediate laminating sheets.

It is yet another object of this invention to provide an improved method and system for image transfer from a photoconductive surface which does not change the look and feel of the sheet which receives the image.

SUMMARY OF THE INVENTION

An imaging system incorporating the invention includes a movable photoconductive surface, and an electrostatic system for repetitively charging the photoconductive surface to a first charge potential. A laser system selectively discharges the photoconductive surface to a second charge potential in accordance with image signals. A color toner supply provides color toner to the photoconductive surface, the color toner exhibiting a charge state that is attracted by the second charge potential and is repelled by the first charge potential. An adhesive toner supply provides adhesive toner to the photoconductive surface, the adhesive toner exhibiting an opposite sense charge state to the color toner. The adhesive toner is attracted by the first charge potential and is repelled by the second charge potential. A controller causes the color toner to be applied to the imaged photoconductive surface and the entire photoconductive surface is recharged. Thereafter, the laser system discharges non-imaged areas of the photoconductive surface to a charge potential that repels the adhesive toner. Then, the adhesive toner is applied to imaged areas which remain at the first charge potential. During a subsequent image transfer the adhesive toner aids in complete image transfer.

DESCRIPTION OF THE DRAWINGS

FIG. 1 is a schematic diagram of an electrophotographic imaging system which incorporates the invention hereof.

FIG. 2 is a partial view of The system of FIG. 1 that illustrates normal toning of a photoconductive surface using a discharge area development method.

FIG. 3 is a partial view of the electrophotographic surface of FIG. 1 showing selective application of an adhesive toner to pre-toned areas, employing a charge area development method.

DETAILED DESCRIPTION OF THE INVENTION

Figure 4:
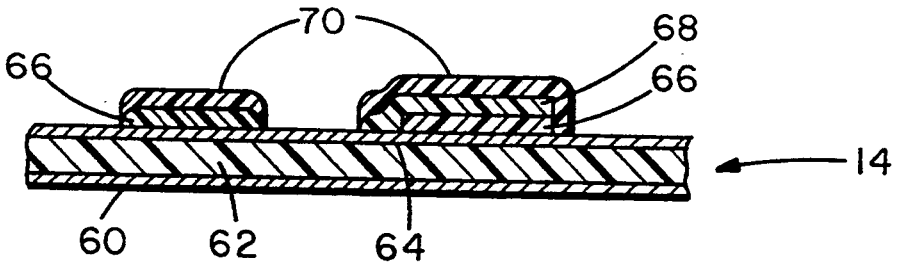
FIG. 4 is a section view of the electrophotographic surface illustrating toned areas that have been developed and adhesively toned.

As will become apparent from the description below, the method of the invention forms an adhesive film only over imaged areas on a photoconductive surface. In other words, a top layer of film-forming, high-tack, polymeric resin is developed, using known principles of electrophotography, over pre-toned, imaged areas already developed on the photoconductive surface. The adhesive layer is then brought into contact with a desired receiving medium (e.g. paper), with the adhesive nature of the polymeric resin promoting transfer to the receiving medium. As will become apparent, the adhesive resin particles exhibit an opposite charge sign to the charge sign of color toner particles.

The polymeric resin that is used to provide a laminating adhesive between a paper surface and color toner particles is essentially (in a preferred embodiment) a colorless "toner". In the case of a liquid toner system, it is comprised of a hydrocarbon dispersing medium, such as Isopar (available from Exxon Chemical America's, P.O. Box 3272, Houston, TX 77001) or other isoparaffinic solvents and dispersed particles of the charged laminating resin. Other additives such as stabilizing, drying or dispersing agents, U.V. blockers and the like may also be included.

In the case of a dry powder system, no dispersing medium is including with the charged resin particles. The dry powder toner system may also include dry stabilizers, U.V. blockers or other additives, as desired. In either case, there is no colorant present to interfere with the adhesive properties of the colorless toners. The resin particles chosen for use as the adhesive toner may be chosen to exhibit a glass transition temperature that is lower than the glass transition temperature of resins employed in the color toners. This will tend to make the adhesive toner particles tackler at development and transfer temperatures.

Turning to FIG. 1, a color electrophotography system 10 comprises a drum 12 that is coated, in the known manner, with a photoconductive surface 14. While a drum 12 is shown, those skilled in the art will realize that any continuous photoconductive surface 14 may be employed with this invention. An electrostatic charging station I 6 charges photoconductive surfaces 14 as it passes therebeneath. A laser I 8 subsequently exposes selected areas of precharged photoconductive surface 14 to create image areas which exhibit a different charge level. Using the customary principles of discharge area development (DAD), photoconductive surface 14 must be capable of charging to the same sign of electrical potential as charges on a toner to be subsequently used for development. For example, when photoconductive surface 14 is charged by electrostatic charging station 16 to a positive potential, the color toner must also have a positive charge. The invention may also be implemented when photoconductive surface 14 is pre-charged to a negative potential and the toner is negatively charged. The DAD process is preferred because printed dots are oval or elliptical and provide a better print quality in terms of printed image edge smoothness.

Using the DAD process, laser 18 discharges selected areas on photoconductive surface 14. Thus, assuming that electrostatic charging station 16 causes photoconductive surface 14 to have a high positive potential, laser 18 acts to discharge photoconductive surface 14 to a more negative potential. It is to be understood that the potential values to be hereafter described are relative to each other and not with respect to any absolute value or measure.

In FIG. 2, photoconductive surface 14 is shown after having been charged to a high positive potential by electrostatic charging station 16. Beam 20 from laser 18 reduces (i.e. "discharges") the charge potential on electrostatic surface 14 to a more negative level in accordance with applied image signals. When a discharged area 22 reaches the vicinity of a toner supply 24, controlling signals are applied which enable release of positively charged toner particles 26 that adhere to discharged area 22 to produce a developed spot 28.

Returning to FIG. 1, electrophotographic system 10 is controlled by a microprocessor 30 which, in combination with image information in raster image buffer 32, feeds image data to laser 18 through laser control circuit 34. Microprocessor 30 also issues signals to operate toner supply control module 36 which in turn generates signals to control cyan, yellow, magenta, black and adhesive toner supplies 38, 40, 42, 44 and 46, respectively. A toner conditioning roller 48 both compresses and heats toner applied to photoconductive surface 14. A transfer roller 50 provides both heat and pressure to a media sheet 52 thereby enabling toner transfer to occur from photoconductive surface 14 to media sheet 52.

In performing a color printing action, raster image buffers 22 contain at least three color planes, i.e., cyan, yellow and magenta. In synchronism with the rotation of drum 12, a color plane is read out and controls laser 18 to cause the particular color plane image to be produced on photoconductive surface 14. Toner supply control 36 then causes the appropriate toner module (e.g., cyan module 38), to operate and to develop the exposed cyan image on photoconductive surface 14. That image is then conditioned by roller 48 and proceeds around drum 12, past electrostatic charging station 16 where photoconductive surface 14 is again charged. A second color plane from raster image buffers 32 is then read out and controls laser 18 to discharge areas of photoconductive surface 14 that are to be developed using a second color toner. (At this point, it is to be noted that there is no media sheet present in contact with drum 12 and such contact will not occur until all color planes have been read out to control laser 18 to produce registered images.) The exposure/-development actions proceed through the cyan, yellow, magenta and black toner stations, in sequence, until photoconductive surface 14 has been toned in accordance with the image information contained in all raster image buffers 32.

At this stage, the system is ready to apply adhesive toner from adhesive toner supply 46. As will be recalled, the adhesive toner is a colorless resin "toner" that exhibits substantial tack at the transfer temperature. The adhesive toner is applied to all areas of photoconductive surface 14 that have been exposed and developed previously, using toner from one of toner supplies 38, 40, 42 or 44. To produce an image of all non-developed areas of electrophotographic surface 14, microprocessor 30 may via an OR function determine all non-image value pixels stored within raster image buffers 32 and create a non-image for storage in a vacant image buffer. In the alternative, microprocessor 30 may create the necessary non-image pixel information "on-the-fly" by logically combining pixel values from the image planes and causing laser control 34 to operate laser 18 to discharge the non-image areas accordingly.

It will be recalled that the adhesive toner in adhesive toner supply 46 must have a charge that is opposite to that of the charge of color toners in toner supplies 38, 40, 42 and 44. It will be assumed that the color toners have a positive charge and that the adhesive toner is negatively charged. As above indicated, laser 18 exposes photoconductive surface 14 in accordance with pixel data that is representative of non-image areas. In this instance, a "charge area development" (CAD) procedure is employed to enable selective application of the adhesive toner to photoconductive surface 14.

In FIG. 3 photoconductive surface 14 is initially charged by electrostatic charging station 16 to a high positive value. Laser beam 20 is controlled to discharge non-image areas of photoconductive surface 14 as it passes therebeneath. Areas of photoconductive surface I 4 that are covered by toner deposits (e.g. 28, 54) retain their high positive charge. Therefore, when a pre-toned region (54) passes into the vicinity of adhesive toner supply 46, the negatively charged adhesive toner particles are attracted and adhere to the surface of toner layer 54, due to the high positive charge therebeneath. The adjoining areas of photoconductive surface 14 exhibit a relatively negative potential and, as a result exert a repulsive action that prevents the negatively charged adhesive toner particles from depositing thereon. Thus, only those areas which have been previously toned with a color layer will receive a layer of adhesive toner.

In FIG. 4, an expanded view of photoconductive surface 14 is shown after both color and adhesive toning. Photoconductive surface 14 comprises a ground plane 60 that supports an organic conductor 62. A release layer 64 covers organic photoconductor 62 and provides a support for color toners 66 which reside thereon. An overtoned second color toner 68 may be present to provide a secondary color pixel region. Encompassing both colored toner regions is a layer of developed adhesive toner that extends only so far as the underlying color toned regions.

Figure 5:
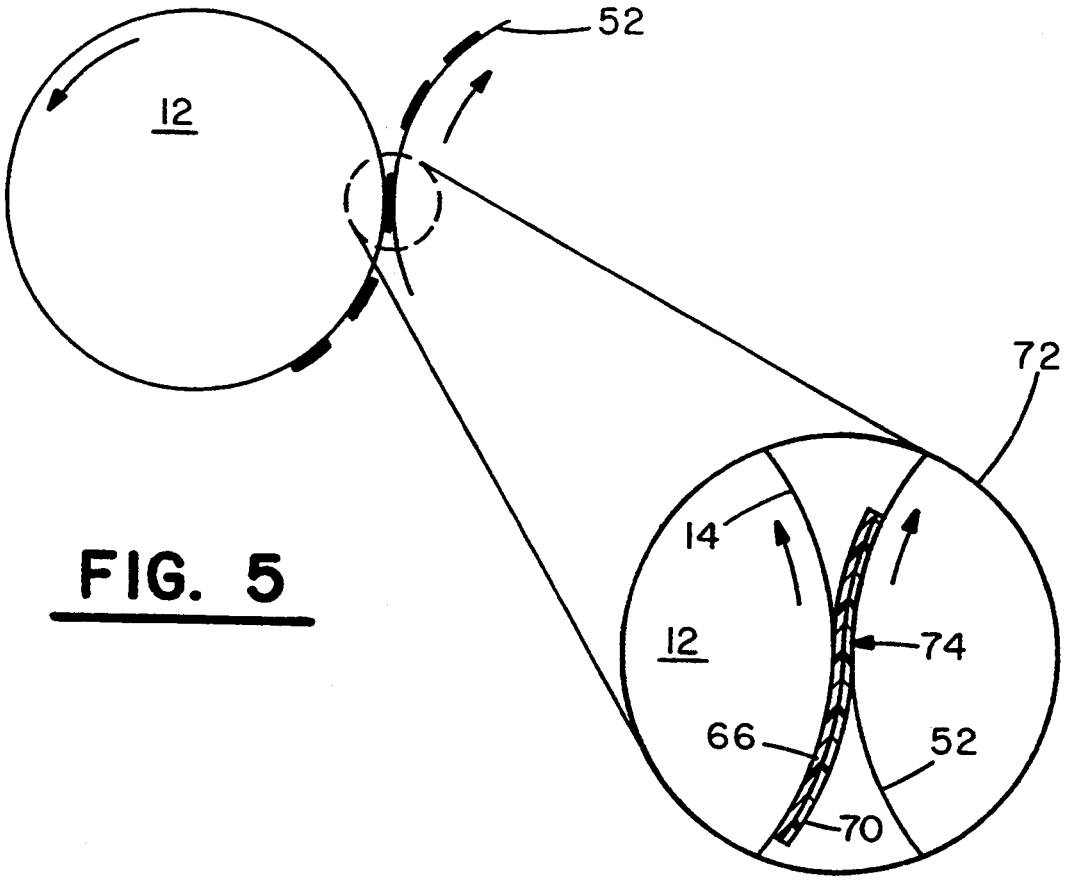
FIG. 5 is a schematic view illustrating the method of transfer of an image from a photoconductive surface to a paper sheet, which image has been processed in accordance with the invention hereof.

Once an adhesive toner has been applied to the pre-toned regions of photoconductive surface 14, a media sheet 52 is introduced between transfer roller 50 and drum I 2 to enable transfer of the developed image on photoconductive surface 14. In FIG. 5, a schematic illustrates the contact region between drum 12 and sheet 52 and illustrates the manner of transfer of toned regions from drum 12 to sheet 52. Magnified region 72 illustrates the transfer of a color toner deposit 66 that has been previously coated with adhesive toner layer 70. At point of contact 74, adhesive toner layer 70 comes into contact with media sheet 52 and adheres thereto, thereby helping to "drag" colored toner layer 66 off of electrophotographic layer 14 and onto media sheet 52.

As can thus be understood, the invention enables the application of adhesive toner to only those areas which have been pre-developed through the application of colored toners. Non-imaged areas do not receive a polymeric coating and thus, the media sheet retains its "feel". The procedure provides an effective transfer mode for images and improved release from the surface of the photoconductor of the pre-toned areas. As the toner is applied only over imaged areas and not over the background, appearance and handling qualities of paper are more pleasing. The cost per page is decreased because the adhesive toner is applied only where needed and not across the entire surface of the sheet. Also, because the background area is not coated, it may still be written on with ordinary pen and pencil. Lastly, quality control problems that may arise as a result of changes in lamination thickness or electrical properties of polymeric sheets are removed. As with colored toners, particle size and charge must be controlled to develop uniform thickness, however, this is a common problem with all toners and its solution is well understood.

While the above invention has been disclosed using discharge area development followed by charge area development, the procedure is equally applicable to an electrophotographic system that employs charge area development followed by discharge area development for the adhesive toner. This embodiment is less preferred because the color toned printed dots are cusped and are more prone to jagged edges.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrophotographic imaging system comprising:

a movable photoconductive surface;

electrostatic means for repetitively charging said photoconductive surface to a first charge potential as said photoconductive surface is moved passed said electrostatic means;

laser means for selectively discharging said photoconductive surface to a second charge potential in accordance with applied image signals;

color toner supply means for providing color toner to said photoconductive surface, said color toner exhibiting a charge state that is attracted by said second charge potential and repelled by said first said charge potential;

adhesive toner supply means for providing adhesive toner to said photoconductive surface, said adhesive toner exhibiting an opposite sense charge state to said color toner, said adhesive toner attracted by said first charge potential and repelled by said second charge potential; and control means for causing said color toner to tone said photoconductive surface in accordance with an image produced thereon by action of said laser means, and for thereafter causing said laser means to alter a charge state of non-imaged area of said photoconductive surface to a charge potential that repels said adhesive toner and to control said adhesive toner supply means to apply said adhesive toner to the imaged areas which remain at said first charge potential.

2. The electrophotographic imaging system as recited in claim 1, further comprising:

means for transferring to a receiving surface, toner that has been applied to said imaged areas, said adhesive toner being directly applied to said receiving surface so as to adhere thereto.

3. The electrophotographic imaging system as recited in claim 1, wherein said adhesive toner is transparent.

4. The electrophotographic imaging system as recited in claim 3, wherein said adhesive toner includes no colorants.

5. The electrophotographic imaging system as recited in claim 1, wherein both said color toner and adhesive toner include resins, the resin in said adhesive toner exhibiting a lower glass transition temperature than the resin in said color toner, whereby said adhesive toner exhibits a tackier surface upon transfer to a media sheet.

6. The electrophotographic imaging system as recited in claim 1, wherein said color toner charge state enables attraction to areas of said photoconductive surface that have been discharged by action of said laser means and wherein said adhesive toner is attracted to areas of said electrophotographic surface that exhibit said first charge potential.

7. The electrophotographic imaging system as recited in claim 1, wherein said color toner charge state enables attraction to areas of said photoconductive surface that remain charged after action of said laser means and wherein said adhesive toner is attracted to areas of said electrophotographic surface that have been discharged to the second charge potential.

* * * * *